US005507109A

United States Patent [19]

Rinzler

[11] Patent Number: 5,507,109

[45] Date of Patent: Apr. 16, 1996

[54] MOBILE ADVERTISING DISPLAY

[76] Inventor: Lyons K. Rinzler, 1776 Peachtree Rd., NW., Suite 340 North, Atlanta, Ga. 30309

[21] Appl. No.: 285,074

[22] Filed: Aug. 3, 1994

[51] Int. Cl.[6] ..... G09F 17/00

[52] U.S. Cl. ..... 40/603; 40/590; 296/181; 160/329

[58] Field of Search ..... 40/603, 604, 590, 40/591; 296/181; 160/328, 329, 368.1, 392, 395

[56] References Cited

U.S. PATENT DOCUMENTS

| | | | |
|---|---|---|---|
| 3,464,480 | 9/1969 | Kuss . | |
| 3,851,848 | 12/1974 | Wiele . | |
| 4,053,008 | 10/1977 | Baslow | 160/392 X |
| 4,233,765 | 11/1980 | O'Mullan et al. . | |
| 4,372,071 | 2/1983 | Vicino . | |
| 4,554,754 | 11/1985 | Stilling . | |
| 4,580,361 | 4/1986 | Hillstrom et al. . | |
| 4,648,573 | 3/1987 | Rubnerth . | |
| 4,674,213 | 6/1987 | Keithley . | |
| 4,754,566 | 7/1988 | Gordon . | |
| 4,800,947 | 1/1989 | Loomis | 160/368.1 |
| 4,828,316 | 5/1989 | Bennett et al. | 296/181 |
| 5,044,416 | 9/1991 | Murray . | |
| 5,058,299 | 10/1991 | Suzuki | 40/590 X |
| 5,083,826 | 1/1992 | McCrary . | |
| 5,239,765 | 8/1993 | Opdahl . | |
| 5,245,774 | 9/1993 | Huber . | |
| 5,255,466 | 10/1993 | Synder . | |
| 5,373,653 | 12/1994 | Suzuki | 40/590 X |
| 5,408,770 | 4/1995 | Suzuki | 40/603 X |

OTHER PUBLICATIONS

Applicant's color photographs of Mobile Media, Inc. advertising display; 5 pages, undated.

*Primary Examiner*—Brian K. Green
*Attorney, Agent, or Firm*—Needle & Rosenberg

[57] ABSTRACT

An apparatus that can be used to display a desired visual message along the lateral surface of a mobile vehicle, such as a truck, van or trailer includes a display panel that can be attached to tracks on the lateral surface. The display panel is suspended at the desired tension with a hook and cord assembly. Retaining rods keep the top and leading edges of the display panel connected to the tracks.

5 Claims, 10 Drawing Sheets

MOBILE ADVERTISING DISPLAY

FIELD OF THE INVENTION

This invention relates to an apparatus for displaying an advertisement or similar graphic on a lateral surface of a moving object such as a truck, van or trailer.

BACKGROUND OF THE INVENTION

A great variety of displays are used to exhibit advertising on the sides of moving vehicles such as vans, buses or tractor trailers. The displays typically are fabricated by painting the advertisement directly on the surface of the vehicle, or by applying sign panels to the surface using adhesives or by applying an adhesive film containing an advertisement. These displays are expensive, difficult to install, and difficult to change in timely fashion. In addition, their useful life is limited by constant exposure to the elements even when not in use. Rigid signs or signs with protective enclosures are easier to change and more impervious to the elements, but are cumbersome and limited in size and can often be prohibitively heavy.

A number of improved displays using tensioned panels have been proposed which are adapted to use on mobile surfaces. These systems offer the ability to change the display in a more timely and efficient manner, while the ability to roll up the panel for easy storage or transport helps reduce environmental wear and prolong the display's useful life. However, complex and costly tensioning frames are typically required in order to tension the fabric panel. For example, U.S. Pat. No. 4,580,361 discloses a tensioning frame which employs edge rails with integral spring tensioners to apply tension to the periphery of an advertising panel. Besides being complex and prone to mechanical failure after prolonged environmental exposure, these edge rails protrude significantly from the mounting surface and may be unusable in some tractor trailer applications because of width restrictions.

U.S. Pat. No. 5,239,765 discloses another type of tensioned panel display which uses an elastic panel tensioned between top and bottom stays which are held in place by two rows of anchors. While this offers an improvement over the more complex mounting frame described above, it suffers from several disadvantages arising from the use of an elastic panel in a rigid mounting. It requires a complex mounting procedure and extensive adjustments in order to achieve and maintain the proper tensioning of the panel. Multiple anchors must be aligned to achieve uniform tension across the panel and minimize wrinkling and flutter. Stretching due to the frame flex inherent in large trailers necessitates frequent readjustment of the stays and anchors. A further disadvantage is that there is nothing, beyond the tension on the panel itself, to prevent the impinging air stream from getting under the leading edge of the panel, causing flutter, damage or dislocation.

It would be advantageous if a mobile advertising display using a tensioned panel could be devised which provides for quick and easy installation, has an easily adjustable tensioning means which compensates for flexure of the structure on which the display is mounted, and has a sealed leading edge which prevents the display from being undermined by an impinging airstream.

SUMMARY OF THE INVENTION

The advertising display of the present invention provides, in one embodiment, a display panel having a top edge, a bottom edge, a leading edge, a trailing edge, and at least one reversible surface for carrying images, and also a leading edge means for removably receiving a first retaining rod near the leading edge, a top edge means for removably receiving a second retaining rod near the top edge, a leading edge track having means for removably engaging the leading edge means for receiving a retaining rod, a top edge track having means for removably engaging the top edge means for receiving a retaining rod, a first retaining rod, a second retaining rod, and means disposed adjacent to the bottom edge and the trailing edge for tautly suspending the display panel. There is also provided an apparatus for displaying an advertisment, in which the display panel is suspended by a means disposed adjacent to bottom edge of the display panel. Another embodiment of the invention provides an apparatus for displaying an advertisement, in which the display panel is suspended by a means disposed adjacent to trailing edge of the display.

The present invention provides many advantages over the prior art. Specifically, an embodiment of the present invention can be built weighing less than 50 pounds for a display which measures 48 feet by 8 feet, which is an improvement over the prior art. Also, after the leading edge track and top edge track have been installed onto the tractor trailer, installion of an advertising display can be accomplished in under 30 minutes. This short amount of time to install the invention enables users to quickly and efficiently transfer displays depending on the desired routes for a specific advertisement. Finally, if the means for suspending the display panel breaks, is vandalized, or is missing or omitted for any reason, the design still affords safety for the driver of the tractor trailer and other motorists, as the sealed leading edge prevents the display panel from acting as an airfoil and being lifted away from or becoming detached from the tractor trailer.

It is an object of the invention disclosed herein to provide a mobile advertising display using a tensioned panel, especially suited for use on a side of a moving vehicle, such as a truck, van or trailer.

It is another object of the present invention to provide a tensioned panel display which is easily installed, uses simple and inexpensive parts, and is quickly adjusted.

It is another object of the present invention to provide a tensioned panel display which can utilize panels of varying sizes and material construction.

It is another object of the present invention to provide a tensioned panel display which is reversible.

It is another object of the present invention to provide a tensioned panel display which can compensate for significant flexure inherent in large vehicles such as tractor trailers.

It is another object of the present invention to provide a tensioned panel display that is not undermined by an impinging air stream as it moves at speed.

DETAILED DESCRIPTION OF THE INVENTION

Figure 1:
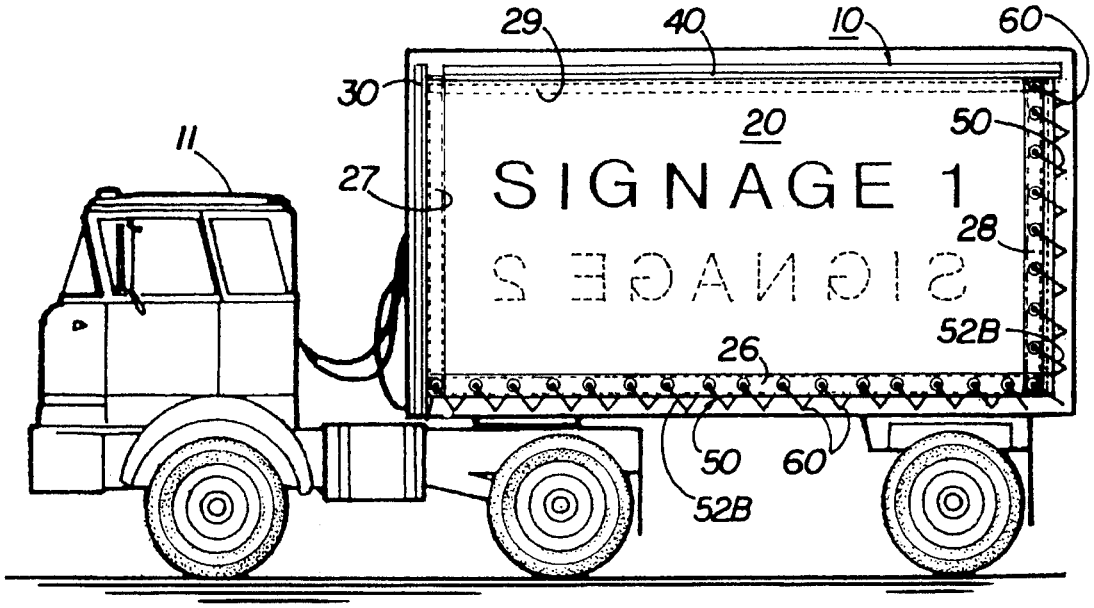
FIG. 1 is a schematic view of an embodiment according to the present invention installed on a side of a tractor trailer.

FIG. 1 is a schematic representation of an embodiment of a display 10 in accordance with the present invention installed on a tractor trailer 11. Display panel 20 is retained at leading edge 27 by leading edge track 30 and at top edge 29 by top edge track 40. Display panel 20 is tautly suspended by means 50 at bottom edge 26 and trailing edge 28.

Figure 2B:
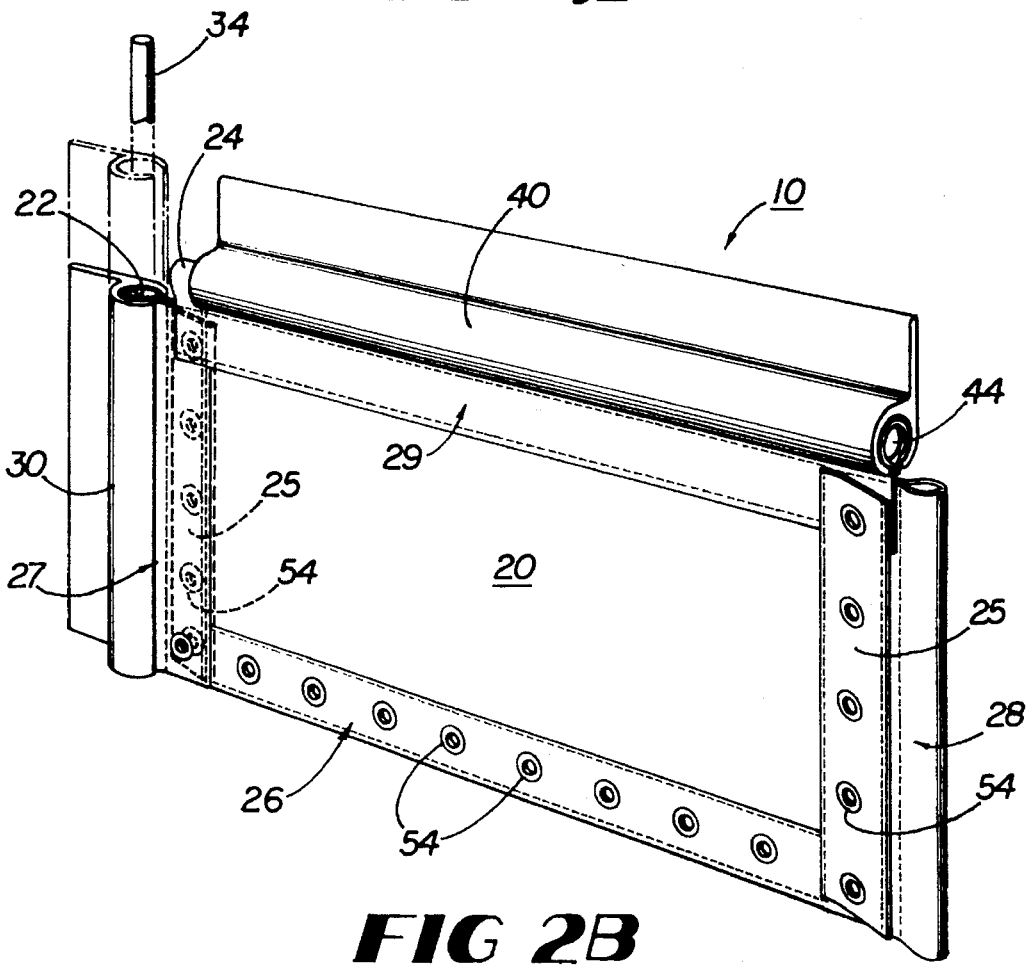
FIG. 2A and FIG. 2B are exploded, simplified views showing components used to retain the leading edge and the top edge of a display panel in accordance with the invention.
Figure 2A:
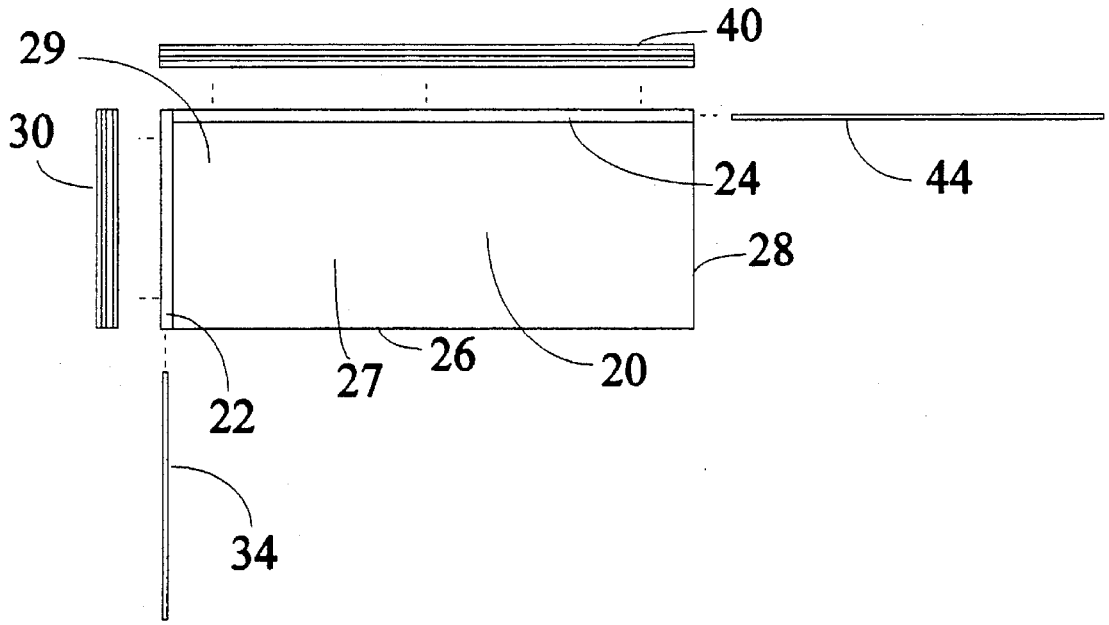

Referring to FIG. 2A, display 10 comprises a display panel 20, with leading edge 27, top edge 29, bottom edge 26 and trailing edge 28. Preferably, display panel 20 comprises a vinyl laminated or coated polyester fabric panel, with an advertising image (not shown) applied to panel 20 using hand painting or computerized printing techniques. In this embodiment, channels 22 and 24 provide means for receiving retaining rods 34 and 44, respectively, and are formed by folding over leading edge 27 and top edge 29, and stitching or otherwise hemming the overlapped portion. Display 10 further comprises leading edge track 30 and top edge track 40. In the embodiment shown, these tracks engage channels 22 and 24 which hold retaining rods 34 and 44, thus retaining leading edge 27 and top edge 29 of display panel 20, respectively.

FIG. 2B shows in greater detail display panel 20 attached to leading edge track 30 and top edge track 40. (FIG. 2B has been somewhat simplified to show fewer eyelets 54 than shown in FIG. 1, and certain details have been exaggerated in scale over that shown in FIG. 1 for clarity of illustration.) Reinforced flaps 25 are attached on both faces of display panel 20. In a preferred emodiment of the invention, flaps 25 are sewn onto display panel 20. On the front face of display panel 20, a first flap 25 is adjacent to trailing edge 29 and on the reverse face of display panel 20, a second flap 25 is adjacent to leading edge 27. Flaps 25 contain eyelets 54 which are used to connect display panel 20 to trailer structures 60, which are not shown in FIG. 2B. Eyelets 54 are on flaps 25 rather than leading edge 27 and trailing edge 28. Thus, when display 20 is mounted on leading edge track 30, air flow under display 20 through eyelets 54 on flaps 25 is prevented.

Figure 3:
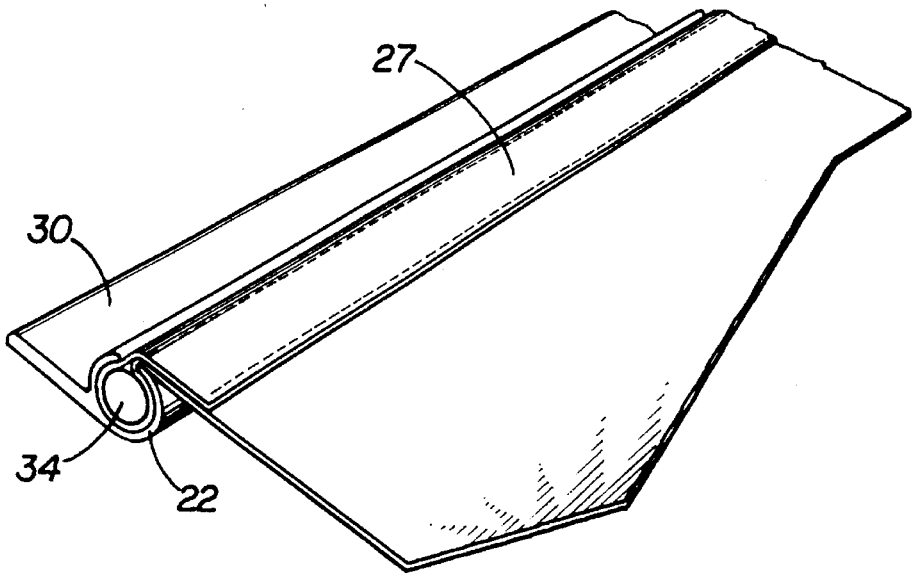
FIG. 3 is a perspective view showing how a leading edge of a display panel is retained in leading edge track in accordance with the invention.

FIG. 3 shows how leading edge 27 is retained by leading edge track 30 in a preferred embodiment of the present invention. Leading edge track 30 and top edge track 40 (the latter not shown in FIG. 3) comprise sections of extruded aluminum awning track, while retaining rods 34 and 44 (the latter not shown in FIG. 3) are flexible "track line" (of either a solid or tubular construction) designed for use with such track. Retention of leading edge 27 in leading edge track 30 prevents leading edge 27 from being undermined. Specifically, because leading edge 27 is sealed into leading edge track 30 and trailing edge 29 is not sealed, there is a negative pressure under display panel 20, allowing it to tightly adhere to the surface of the tractor trailer 11, which is not shown in FIG. 3. The top edge 24 is preferably similarly retained by top edge track 40 and retaining rod 44, although these are not shown in FIG. 3.

Figure 4:
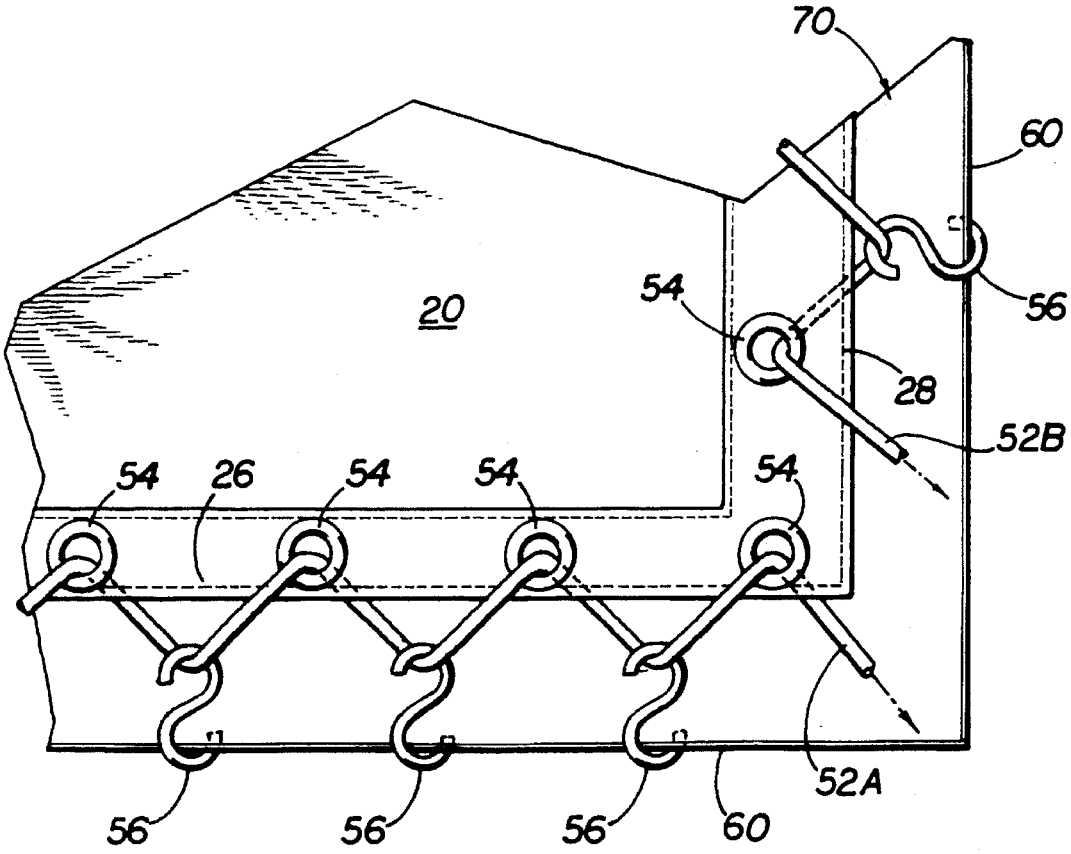
FIG. 4 is a diagram showing how shock cords are engaged by eyelets and S-hooks at a bottom edge and a trailing edge of a display panel in accordance with the invention.

FIG. 4 shows an enhanced view of a corner of display panel 20, where bottom edge 26 and trailing edge 28 meet, along with representative adjacent structures of trailer 70. In the embodiment shown, means for tautly suspending display panel 20 comprises one or more lengths of elastic shock ("bungee") cord 52A and 52B releasably engaged by a plurality of eyelets 54 located near bottom edge 26 and trailing edge 28 of display panel 20, and a plurality of S-hooks 56 connected to trailer structures 60 adjacent to bottom edge 26 and trailing edge 28 of display panel 20. Typically, trailer structures 60 are flanges found along the edges of most trailers. S-hooks 56 have one end hooked onto flanges 60. Two separate lengths of shock cord 52A and 52B are shown, engaging eyelets 54 and ends of S-hooks 56, near bottom edge 26 and trailing edge 28, respectively. The tension in the trailing and downward directions can be easily and independently adjusted by adjusting the tension of each shock cord 52A and 52B. It would be readily apparent to those skilled in the art that a variety of similar tensioning arrangements are possible in the spirit of the present invention.

Figure 5A:
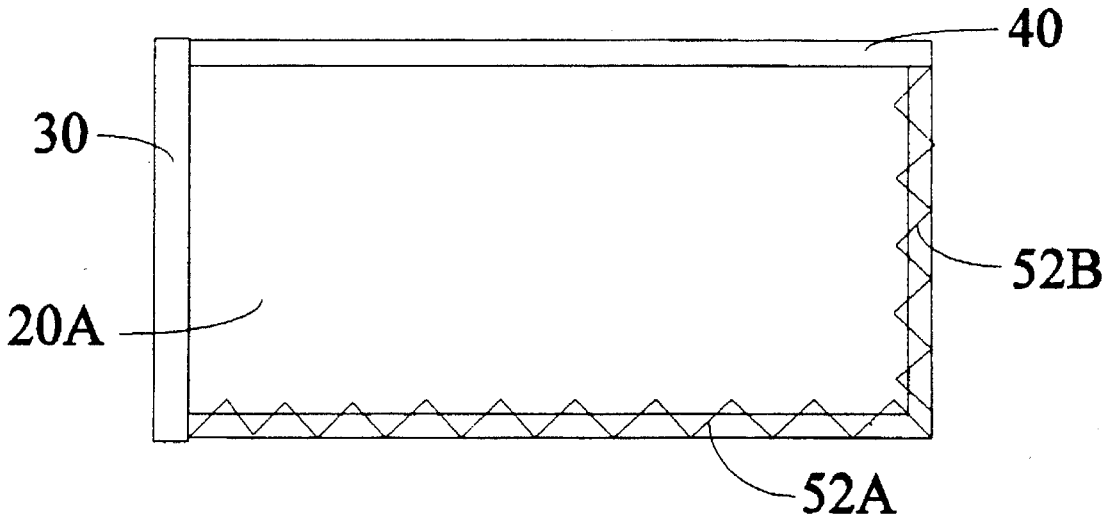
FIGS. 5A and 5B illustrate alternative embodiments of the present invention employing display panels of differing sizes.
Figure 5B:
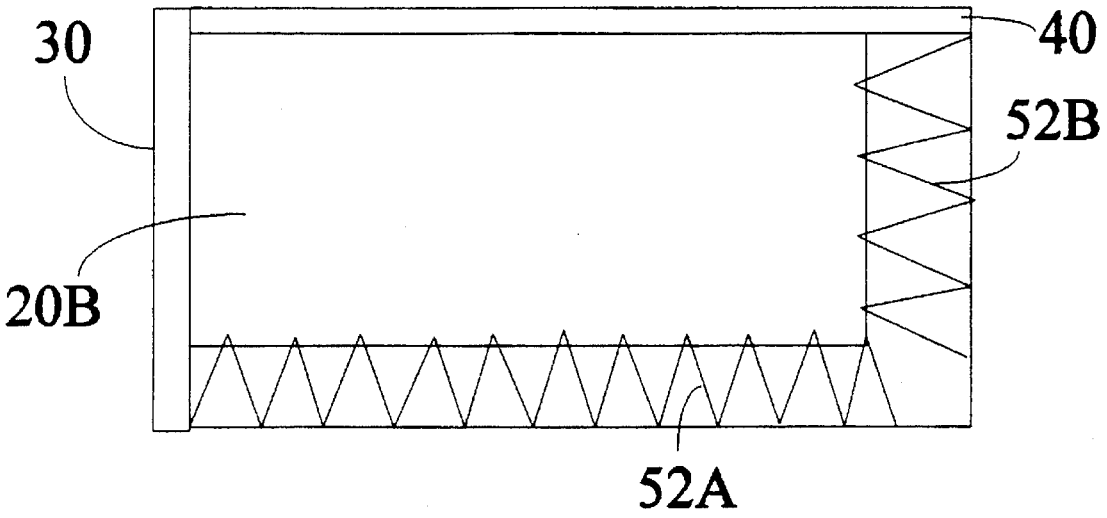
Figure 6A:
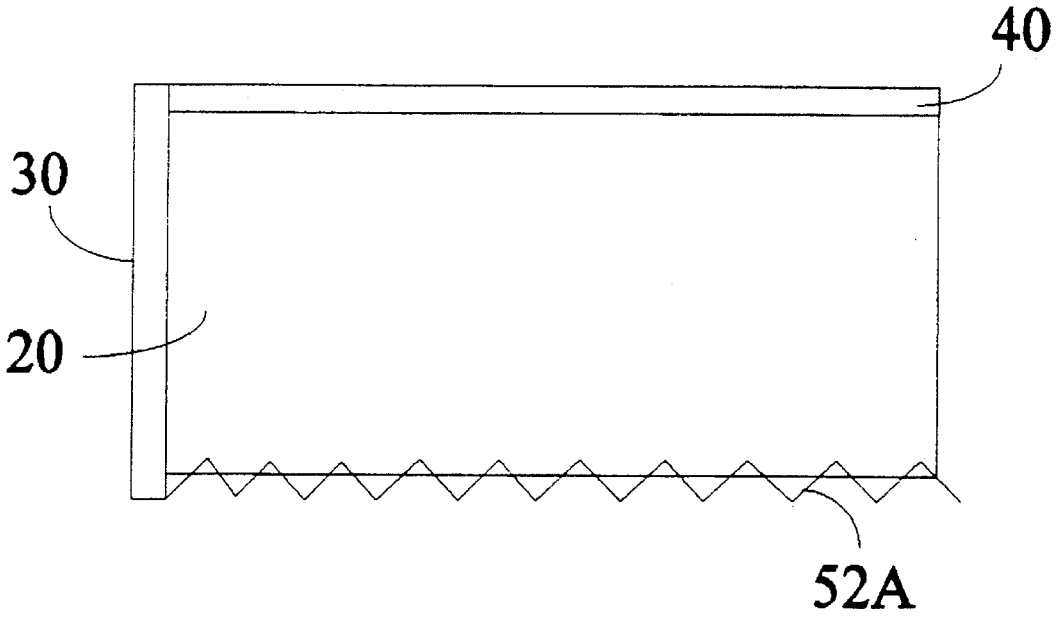
FIGS. 6A and 6B illustrate alternative embodiments of the present invention which employ means for tautly suspending a display panel only at a trailing edge or at a bottom edge of display panel, respectively.
Figure 6B:
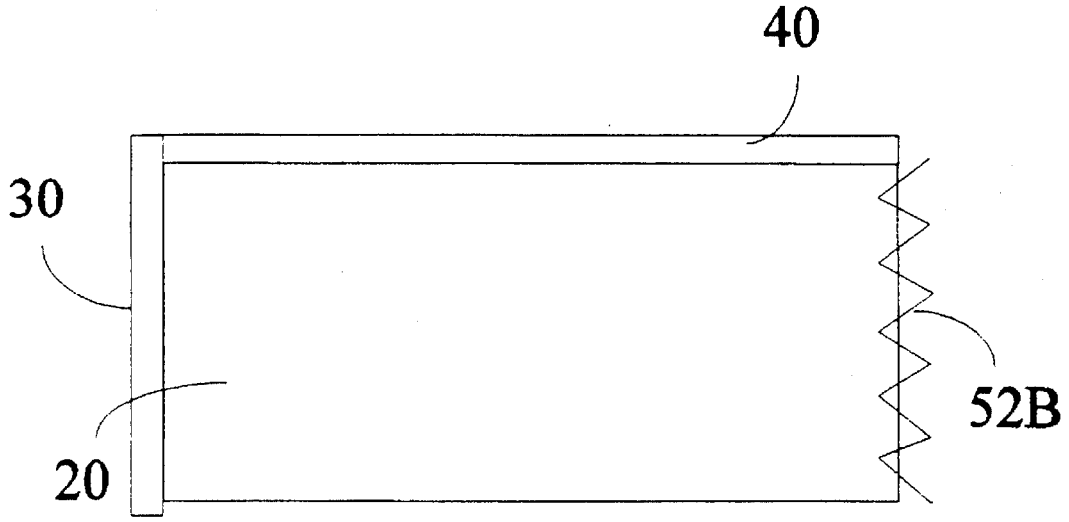

FIGS. 5A and 5B are schematic illustrations showing that embodiments of the present invention can employ display panels 20A and 20B of differing sizes. Different size display panels 20A and 20B allow the invention to meet size requirements of different trucks. Further, it is also not necessary to use both shock cords 52A and 52B; in some applications, one will suffice by adjusting the lengths of cords 52A and/or 52B. FIGS. 6A and 6B are schematic representations of alternative embodiments in which means for tautly suspending display panel 20 is disposed adjacent only to trailing edge 28 of display panel 20.

Figure 7A:
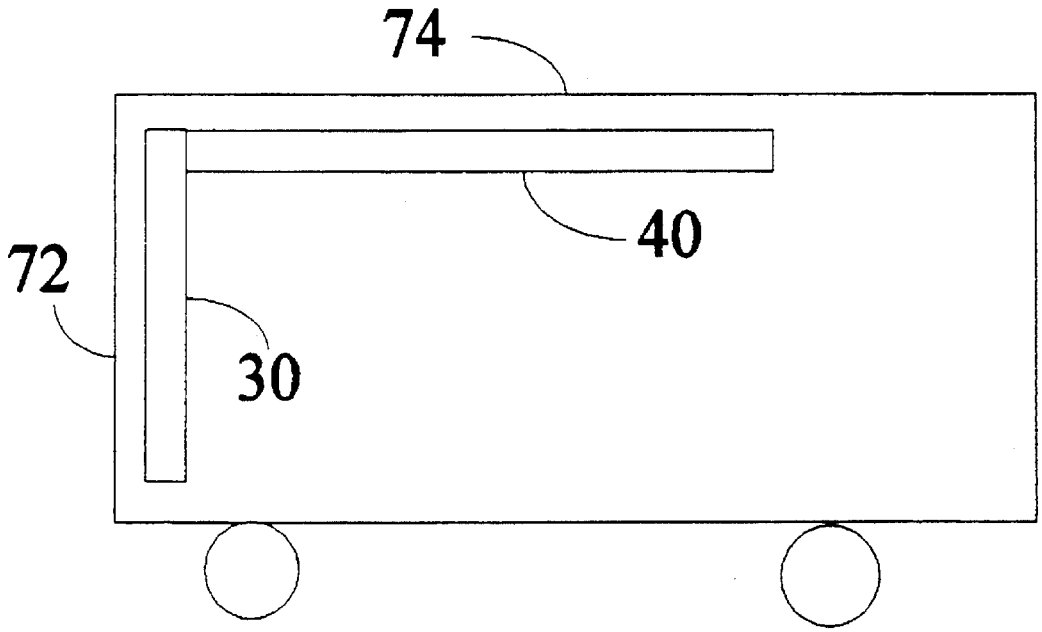
FIGS. 7A through 7C sequentially illustrates a preferred method for installiing the inventive mobile advertising display.
Figure 7B:
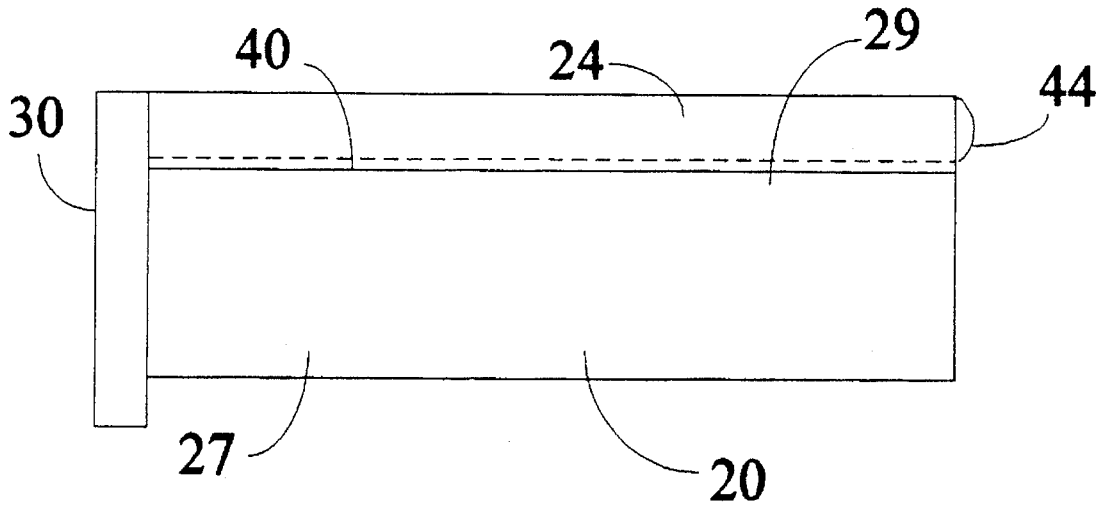
Figure 7C:
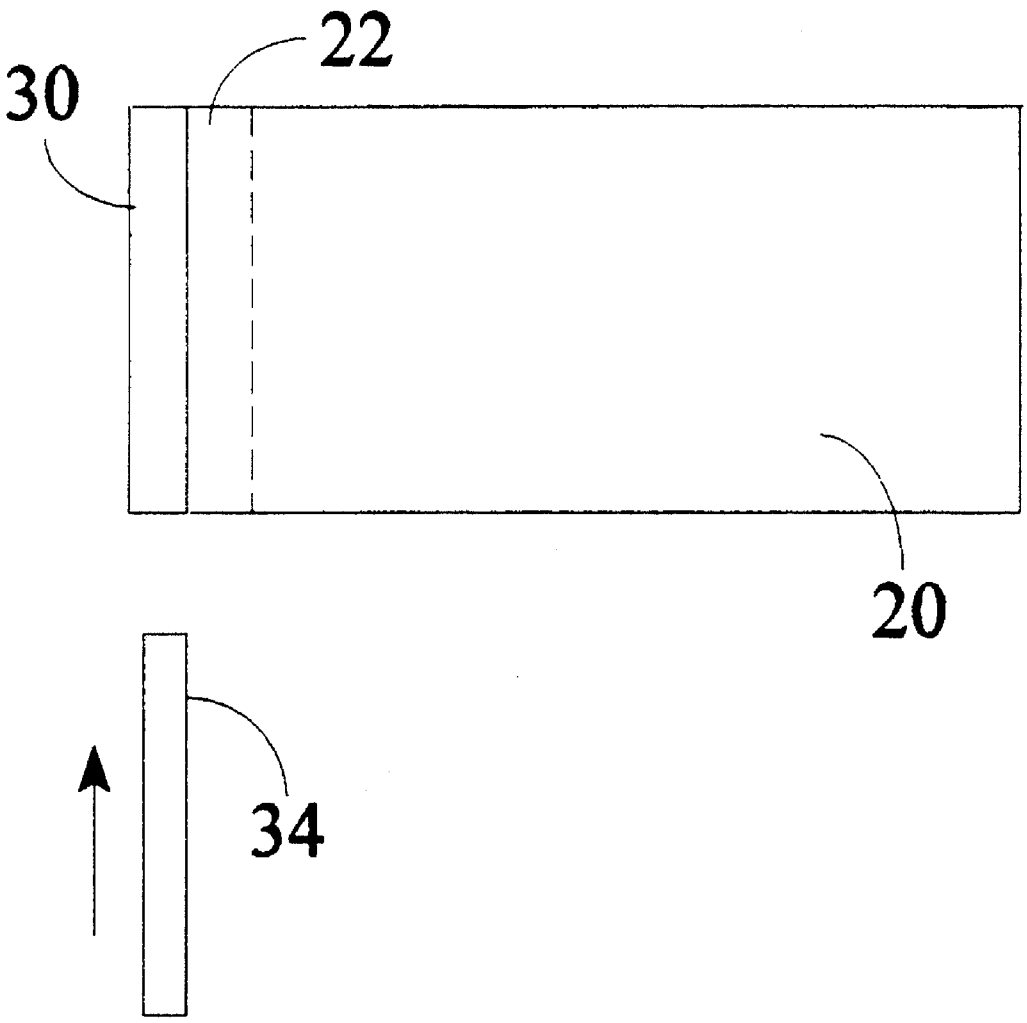

A preferred method of installing an embodiment of the present invention on a side of a tractor trailer is shown schematically in FIGS. 7A through 7C. FIG. 7A shows leading edge track 30 which is attached to the side of the trailer, towards the leading edge 72 of the side of the trailer. Top edge track 40 is attached to the side of the trailer, towards the top edge 74 of the side of the trailer. FIG. 7B shows display panel 20, which is delivered fan-folded or "shelled", with retaining rod 44 inserted in channel 24 at top edge 29. The portion of channel 24 enveloping retaining rod 44 is then fed into top edge track 40, starting at the end of the track closest to the rear of the trailer and continuing forward until leading edge 27 is approximately abreast of leading edge track 30. FIG. 7C shows a portion the channel 22 which is then fed into leading edge track 30, and retained by sliding retaining rod 34 (preferably from the bottom) into the portion of channel 22 received within leading edge track 30. Retaining rod 34 may be held in place in the track by a cotter pin (not shown) or similar retaining means, but the tension on display panel 20 should prevent retaining rod 34 from slipping out of leading edge track 30. S-hooks 56 are hooked onto structures on the trailer adjacent to bottom edge 26 and trailing edge 28 of display panel 20 as shown in FIG. 4. Such structures typically are flanges 60 which run along the bottom and top edges of the sides of most trailers, but other structures, such as holes drilled in the trailer, may suffice. Finally, shock cords 52A and 52 B are strung between eyelets 54 and S-hooks 56, and tensioned to tautly suspend display panel 20 as seen in FIG. 3.

Many other modifications and adaptations to the above-described embodiments within the scope of the invention will be apparent to those skilled in the art. Thus, the scope of the invention is not to be considered as limited by the above-described embodiments, but rather should be determined by reference to the claims that follow.

What is claimed is:

1. A mobile advertising display for displaying images on a trailer structure having a front, a back, a top, and a bottom, the display comprising:

a. a display panel having a top edge, a bottom edge, a leading edge, a trailing edge, a first surface and an opposite second surface, the first surface and the second surface for carrying images, each of the top edge, the leading edge, and the trailing edge defining a channel for slidably receiving a rod, the bottom edge defining a plurality of spaced apart eyelets passing therethrough;

b. a first flap disposed along the leading edge parallel to the channel defined by the leading edge the first flap defining a plurality of spaced apart eyelets passing therethrough;

c. a second flap disposed along the trailing edge parallel to the channel defined by the trailing edge, the second flap defining a plurality of spaced apart eyelets passing therethrough;

d. a first retaining rod that is disposed in the channel defined by the top edge;

e. a second retaining rod that is selectively disposed in either the channel defined by the leading edge or the trailing edge;

f. a top edge track, horizontally disposed adjacent the top of the trailer structure, defining a first c-shaped grove extending along the length of the top edge track, the top edge and the first retaining rod disposed within the first c-shaped groove, thereby affixing the top edge to the top edge track;

g. a leading edge track, vertically disposed adjacent the front of the trailer structure, defining a second c-shaped grove extending along the length of the leading edge track, a selected edge of either the leading edge or the trailing edge and the second retaining rod disposed within the second c-shaped groove, thereby affixing the selected edge to the leading edge track;

h. a first elastic shock cord for coupling the eyelets defined by the bottom edge to the bottom of the trailer structure, thereby vertically tensioning the display panel; and i. a second elastic shock cord for coupling the eyelets defined by a selected flap of either the first flap or the second flap to the back of the trailer structure, thereby horizontally tensioning the display panel.

2. The display of claim 1 wherein said display panel comprises a fabric.

3. The display of claim 2 wherein said flap is reinforced.

4. The display of claim 2 wherein said fabric comprises vinyl polyester laminate.

5. The display of claim 2 wherein said fabric comprises vinyl coated polyester.

* * * * *